US007754950B2

(12) United States Patent
Leach

(10) Patent No.: US 7,754,950 B2
(45) Date of Patent: Jul. 13, 2010

(54) TRAVEL STRING INSTRUMENT AND METHOD OF MAKING SAME

(75) Inventor: Harvey Leach, Cedar Ridge, CA (US)

(73) Assignee: Voyage-Air Guitar Inc., Livermore, CA (US)

( * ) Notice: Subject to any disclaimer, the term of this patent is extended or adjusted under 35 U.S.C. 154(b) by 210 days.

(21) Appl. No.: 11/958,341

(22) Filed: Dec. 17, 2007

(65) Prior Publication Data

US 2009/0173207 A1 Jul. 9, 2009

(51) Int. Cl.
*G10D 3/00* (2006.01)

(52) U.S. Cl. ..... 84/293; 16/357; 16/358; 16/369

(58) Field of Classification Search ..... 16/357, 16/358, 269; 84/293; 15/357, 358, 369
See application file for complete search history.

(56) References Cited

U.S. PATENT DOCUMENTS

| | | | | | |
|---|---|---|---|---|---|
| 33,830 | A | * | 12/1861 | Dodge | 16/366 |
| 869,717 | A | * | 10/1907 | Kluge | 16/250 |
| 880,697 | A | * | 3/1908 | Soss | 16/357 |
| 1,030,936 | A | * | 7/1912 | Soss | 16/369 |
| 1,280,357 | A | * | 10/1918 | Zuckerman | 16/369 |
| 1,282,435 | A | * | 10/1918 | Korb | 16/360 |
| 1,619,502 | A | * | 3/1927 | Fox | 16/358 |
| 1,925,209 | A | * | 9/1933 | Schwartz | 16/358 |
| 2,021,702 | A | * | 11/1935 | Soss | 16/369 |
| 2,040,279 | A | * | 5/1936 | Soss | 16/273 |
| 2,135,280 | A | * | 11/1938 | Erickson | 16/369 |
| 2,178,271 | A | * | 10/1939 | Soss | 16/358 |
| 2,596,816 | A | * | 5/1952 | Lieberman | 16/358 |
| 2,608,713 | A | * | 9/1952 | Soss | 16/337 |
| 3,881,221 | A | * | 5/1975 | Schmidt | 16/366 |
| 3,886,627 | A | * | 6/1975 | Bassan | 16/387 |
| 4,780,929 | A | * | 11/1988 | Burns et al. | 16/349 |
| 5,044,044 | A | * | 9/1991 | Young et al. | 16/323 |
| 5,946,774 | A | * | 9/1999 | Ramsey et al. | 16/357 |

(Continued)

*Primary Examiner*—Jeffrey Donels
*Assistant Examiner*—Robert W Horn
(74) *Attorney, Agent, or Firm*—Anthony H. Handal; Handal & Morofsky, LLC

(57) ABSTRACT

A string instrument comprising a neck extension primary member, having a neck extension securement end and a tuning assembly support head end, an extension top and a length extending between the ends, is disclosed. The neck extension primary member defines a neck extension cutaway volume configured to receive a hinge butt. The neck extension cutaway volume extends to be open at the neck extension securement end and open at the top of the neck extension primary member. A neck base primary member has a neck base securement end, a base top and an opposite end. The neck base primary member is made to define a neck base cutaway volume configured to receive a hinge butt. The neck base cutaway volume extends to be open at the neck base securement end and open at the top of the neck base primary member. A hinge has a first hinge butt positioned in the neck extension cutaway volume and a second hinge butt positioned in the neck base cutaway volume. A neck fretboard portion is secured over the open top of the neck extension cutaway volume and bears against the first hinge butt. A base cover is secured over the open top of the neck base cutaway volume and bears against the second hinge butt. A string instrument main body is secured to the neck base primary member.

21 Claims, 12 Drawing Sheets

U.S. PATENT DOCUMENTS

| | | | | |
|---|---|---|---|---|
| 6,647,592 | B2 * | 11/2003 | Presley | 16/366 |
| D516,114 | S * | 2/2006 | Leach | D17/20 |
| 7,203,997 | B2 * | 4/2007 | Morgan | 16/358 |
| 7,579,535 | B2 * | 8/2009 | Pyper-Scott | 84/293 |
| 7,652,205 | B2 * | 1/2010 | Leach | 84/293 |
| 2006/0070212 | A1 * | 4/2006 | Morgan | 16/358 |
| 2007/0289427 | A1 * | 12/2007 | Liang | 84/291 |
| 2008/0141488 | A1 * | 6/2008 | Leach | 16/223 |
| 2008/0141842 | A1 * | 6/2008 | Leach | 84/293 |
| 2008/0289146 | A1 * | 11/2008 | Chen | 16/372 |
| 2009/0151537 | A1 * | 6/2009 | Leach | 84/293 |
| 2009/0173207 | A1 * | 7/2009 | Leach | 84/293 |

* cited by examiner

TRAVEL STRING INSTRUMENT AND METHOD OF MAKING SAME

BACKGROUND OF INVENTION

The manufacture of note producing musical instruments began as a search for the mechanical equivalent of the human voice. This in fact remained the standard through the Middle Ages and into the Renaissance and the early modern period.

Stringed instruments have been known since ancient times. These included such instruments as the lute, a guitar-like instrument with a sound box and fingerboard. A New Kingdom (ancient Egypt, 1380 BC) bronze in the collection of the Metropolitan Museum of Art depicts a dancing Nubian raised on his toes with one knee cocked, left hand high working a fingerboard and right had plucking the stings in a pose which might be illustrative of a modern rock musician.

But the late has a much more ancient history, perhaps originating with West Semitic nomadic people who brought the instrument to Mesoptamia, where the archaeological record includes representations dating back to the Akkadian period (2350 to 2170 B.C.), being introduced to the Egyptians, perhaps at the end of the Middle Kingdom Hyksos dynasties (XV to XVII dynasty, 1730 to 1580 B.C.).

In more recent times, stringed lute-like musical instruments continue to be among the most popular instruments. Folk artists throughout the United States have used the guitar, sometimes one of the homemade variety, in a wide range of musical genres including blues, bluegrass, and so forth.

In contrast to percussive instrumentation, the need for amplification of the relatively weak sounds of stings, reeds, and vibrating human lips presented challenges to early musical instrument manufacturers. These challenges were met primarily by resonant systems that mechanically concentrate, and output musical sound. There is a demanding standard in the stability of the instrument if high-quality sound is to be produced.

Moreover, over the years, artists playing acoustic stringed instruments have introduced a wide variety of playing techniques into the music surrounding these instruments. While, perhaps, the ancients only plucked the strings of the lute to achieve a musical tone which gradually decayed, later artists used the bow to produce notes of relatively constant and somewhat controllable amplitude. Modern artists employ a variety of techniques in their performances. Acoustic blues performers may rap their instruments with fingertips, palms or knuckles. Certain violin compositions, typically played by having a horsehair bundle slide across the strings, also call for the strings to be plucked. This results in yet greater demands being put on the mechanical stability of the instrument.

Given the popularity of stringed musical instruments, especially the guitar, people of take them along when traveling. However, they are bulky and poorly suited to convenient transport. They are unlikely to fit into airline stowaway spaces or under airline seats. In response to this need, guitars with folding necks have been proposed. See for example my earlier U.S. Design Pat. No. 516,114, and my earlier pending U.S. patent application Ser. No. 11/640,095, filed Dec. 15, 2006. While this instrument is effective, it is difficult to make requiring significant handwork and fine tuning.

Accordingly, there is a need for a stringed instrument which may be a guitar, violin or the like and which is easy to use during a performance, consistent, and rigorous in its transduction of artistic interpretations into an acoustic or other performance and easily transportable. It is believed that the structure disclosed herein is the most effective solution consistent with the style of many acoustic stringed instrument performers.

This invention also relates to hinges and particularly what is commonly known as invisible hinges for the use in connection with doors and other swinging articles and the invention described here is an improvement on previous designs for the specific use where a very narrow surface is available for the hinge mechanism and the hinge must be able to support a proportionally much longer perpendicular surface. Also significant to this invention is the method used to locate and install the hinges.

In this type of hinge the hinge parts are connected by pivoted linkages hinged on a hinge pin and sliding on sliding pins, the linkages being within pockets or compartments within the hinge parts, that is the hinge plates or butt plates. An early version of such hinges is a hinge design created by Joseph Soss and bearing his name. It is illustrated in several patents including U.S. Pat. Nos. 1,030,936, 1,484,093, 1,688,996, 1,984,092, and 2,178,271 among others. A hinge of this sort is employed in the above referenced design patent.

These hinges are designed to be invisible when in the closed position and allow for the focal point of the hinge to be below the surface when in the closed position and then extend beyond the surface to allow for a full 180 degree opening. Two basic versions of the hinge are common, the first having a long narrow body with two attachment screws, one located at each end. This style is of a shape requiring a multi-level mortise cut for installation, the second is a cylinder or barrel hinge with a side mounted screw as a means of attachment and requiring a hole to be bored for installation.

These previous designs are of a similar nature but either lack the clearance necessary, have methods of attachment that are either insufficient or impractical in a guitar with a folding neck and also require a complex process to create the openings for the hinge butt plates or cylinders.

Furthermore, while a version of the previous design has been proven capable of supporting this application to some extent in above U.S. Design Pat. No. D516,114, it has been found lacking in several areas with regard to effective production beyond the small, hand assembly shop.

First, these hinges, known as "barrel hinges," require a final outer surface, an example being a fretboard on musical instruments, to be attached out of sequence with normal production procedure and require holes to be bored extremely close to the surface of the fretboard weakening this via structural member.

Second, these hinges are very difficult to set accurately with respect to depth and alignment. The other version of Soss hinge has better means of securement and greater location and depth control. However, its design only allows for a single hinge to fit in the required area which lacks the structural integrity for this application and lacks sufficient capability to adequately align the two hinged parts. Furthermore, the location of the securement screws is too close to the outer edges of the members, which in this application creates problems because of the tack of material for the screws to properly secure themselves. Currently available versions also lack the opening clearance needed for guitar hinge application. Finally, the means required to cut the mortises is very time consuming and difficult to consistently achieve.

SUMMARY OF INVENTION

In accordance with the invention, a string instrument comprises a neck extension primary member having a neck extension securement end and a tuning assembly support head end, an extension top and a length extending between the ends. The neck extension member defines a neck extension cutaway volume configured to receive a hinge butt. The neck extension cutaway volume extends to be open at the neck extension securement end and open at the top of the neck extension primary member. A neck base primary member has a neck base securement end, a base top and an opposite end. The neck base primary member is made to define a neck base cutaway volume configured to receive a hinge butt. The neck base cutaway volume extends to be open at the neck base securement end and open at the top of the neck base primary member. A hinge has a first hinge butt positioned in the neck extension cutaway volume and a second hinge butt positioned in the neck base cutaway volume. A neck fretboard portion is secured over the open top of the neck extension cutaway volume and bears against the first hinge butt. A base cover is secured over the open top of the neck base cutaway volume and bears against the second hinge butt. A string instrument main body is secured to the neck base primary member.

Two or more Soss link assemblies are connected to a single pair of hinge butts, with each of the butts defining a pair of Soss hinge link receiving races, to form a pair of spaced apart Soss hinge assemblies formed on the sine pair of hinge butts.

The hinge butts each define a securement screw receiving bore oriented to extend the length of the sting instrument neck.

The neck extension member is provided with a mounting for a screw and the neck base primary member defines a hole for receiving that screw. This allows the neck base primary member and the neck extension primary member to be secured in the playing position.

The inventive hinge comprises a first hinge butt defining a pair of first and second races for receiving a first Soss sliding hinge pin. A second hinge butt defines a pair third and four races for receiving a second Soss sliding hinge pin. A first Soss link assembly is mounted between and in the first and third races. A second Soss link assembly is mounted between and in the second and fourth races, the second Soss link assembly being positioned adjacent and spaced apart from, as well as extending in the same direction as the first Soss link assembly.

In accordance with the preferred embodiment, the first hinge butt defines a hole between the first and second races. The second hinge bun defines a hole between the third and fourth races. The hole is oriented to receive an attachment member for urging and attaching the hinge into a member to be hingedly mounted.

The hinge bum may be rectangular in configuration with flat sides and rounded corners or flat sides and for example pointed substantially 90° corners.

The hole between the first and said second races may be aligned substantially in the same direction as the races.

BRIEF DESCRIPTION OF THE DRAWINGS

The structure and method of construction of a guitar constructed in accordance with the invention will be understood from the following drawings, taken in conjunction with the description below, and in which.

DETAILED DESCRIPTION OF THE BEST MODE

Figure 1:
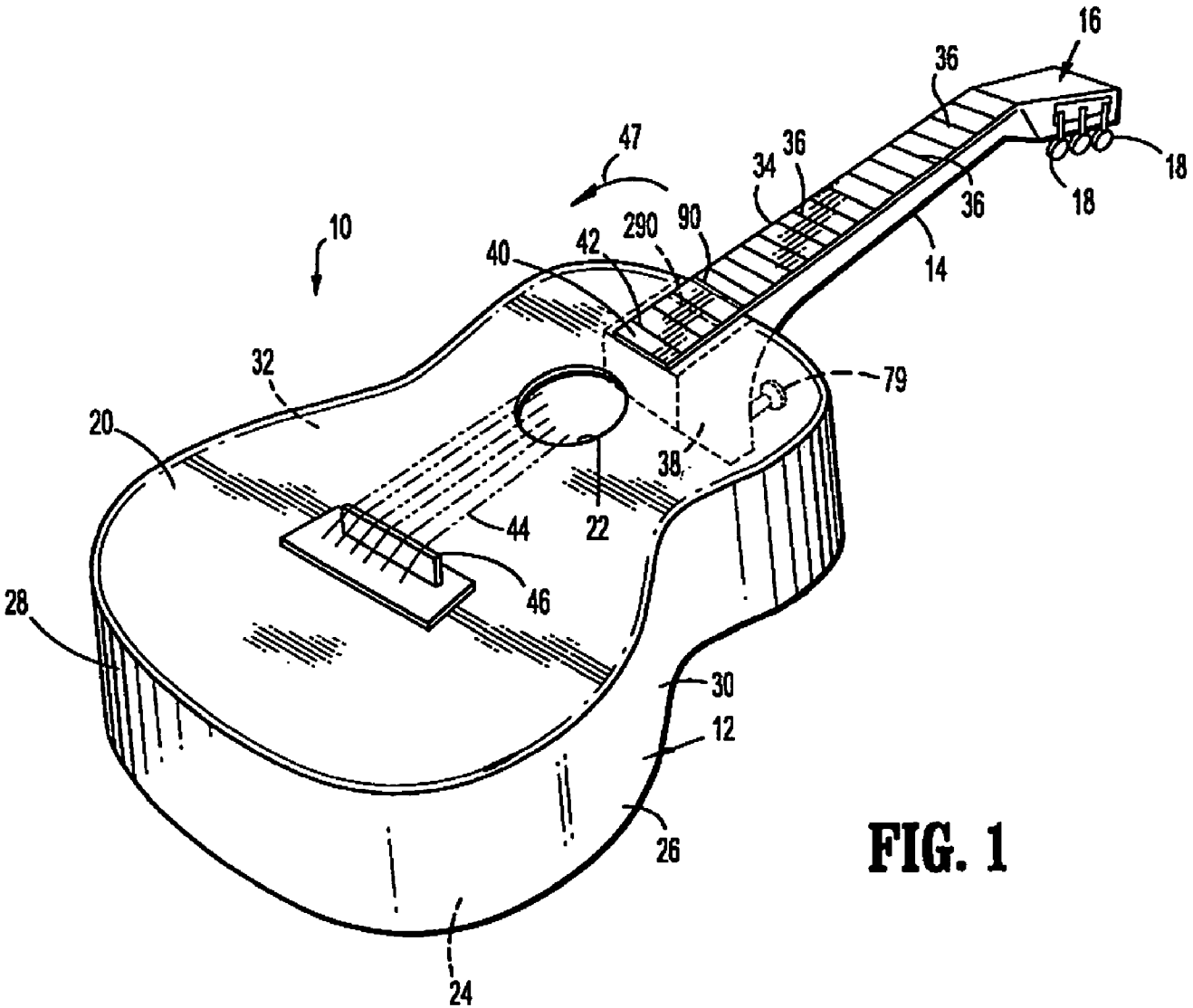
FIG. 1 is a prospective view of one embodiment of the inventive stringed musical instrument, in this case an acoustical guitar, in a playing position, viewed from the top side.

Referring to FIG. 1, a musical instrument constructed in accordance with the present invention is illustrated. While the invention may be employed in connection with acoustic or electrical guitars, violins, violas, bases, banjos or other stringed instruments, for purposes of illustration an acoustical guitar 10 is illustrated.

Generally, guitar 10 comprises a large hollow body 12, secured to the inventive neck 14. Neck 14 comprises a head 16, which accommodates tuning screws 18 in a conventional manner.

Body 12 comprises top plate 20 which defines a sound hole 22. But the plate 24 is secured to top plate 20 by bouts 26 and 28 which together form a guitar sound box sidewall having U-shaped upper and lower ends at the heel and tail ends of the body 12, and a curved central bout 30 and curved central bout 32 (not illustrated) which form the waist of the instrument.

Neck 14 supports a neck fretboard 34, which is glued to neck 14. Neck fretboard 34 supports a plurality of frets 36. Neck base 38 supports a neck base fretboard 40, which is glued to neck base 38. Neck base fretboard 40 supports a plurality of frets 42, against which strings 44 are played. For purposes of clarity of illustration, stings 44, which are supported by bridge 46 are illustrated partially and in phantom lines.

Figure 2:
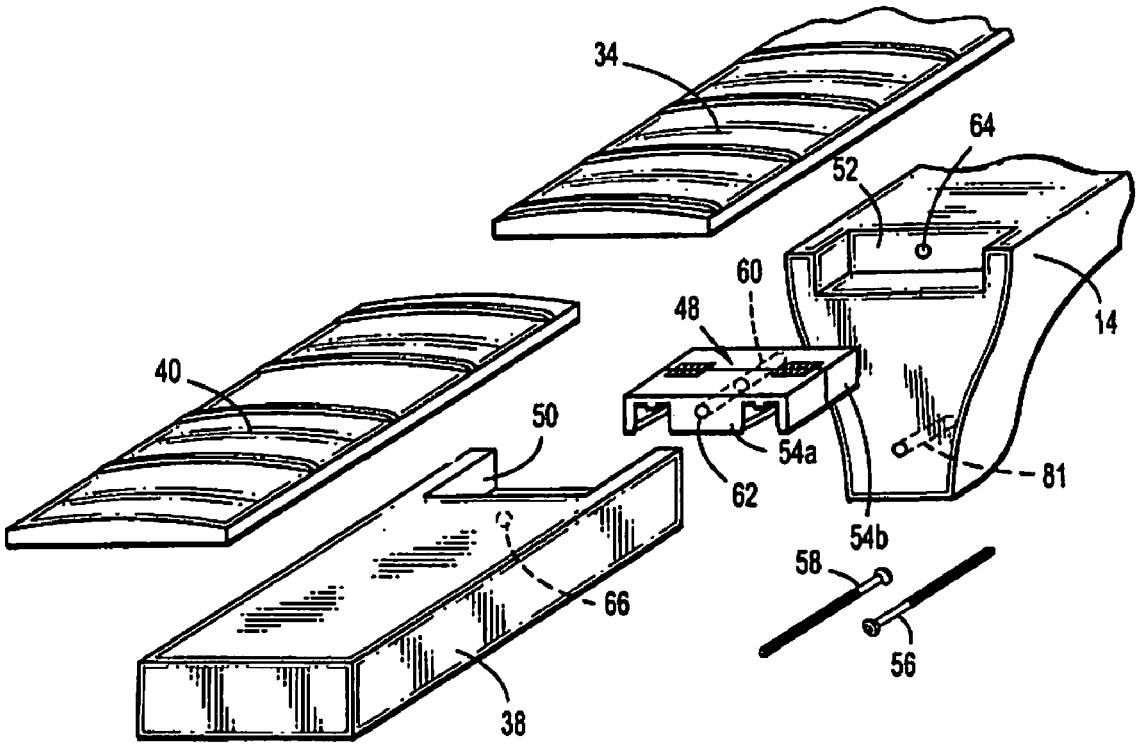
FIG. 2 is an exploded perspective view of one possible configuration of the inventive traveling stringed musical instrument.

The construction of the guitar illustrated in FIG. 1 may be understood from FIG. 2 which schematically illustrates principal parts in exploded perspective.

One of the objectives of the invention is to create a hinge that has a simpler and more easily repeatable method of installation. Moreover, in the preferred embodiment, this installation can be achieved prior to attaching the final surface, such as musical instrument fretboards 34 and 40.

The invention also provides a method of securely attaching the hinge in a manner that can be quickly and easily installed or removed. The inventive hinge cooperates with hinge pockets which may be cut into the neck parts vertically instead of horizontally, thereby simplifying the procedure. Vertical cutting of the pockets is simpler to accomplish, faster and easily repeatable with good precision.

Because of the hinge's square, box-like shape, this cut can be accomplished with a router and simple fixtures as well as more sophisticated production methods. Because this step can be accomplished very early in the machining process it allows for it to be seamlessly integrated into a process such as typical musical instrument neck building. This new design also allows for a center mounting screw which can be attached to the most structurally sound area, it also allows for more secure methods such as metal inserts or barrel nuts to be used for the screw to feed into adding strength as well as the ability to repeatedly remove the screw for production reasons as well as in future repair or replacement operations.

One of the other advantages of the preferred embodiment of the invention is the provision of a double hinge that by having two parallel hinged members can, as a single hinge, effectively do the work of two hinges which would normally require a substantially wider surface available for a pair of hinged mechanisms. The inventive hinge is configured with a greater opening clearance when the guitar neck is in the folded position. This accommodates the unique curved surfaces commonly found in items such as musical instruments. These surfaces, such as the fretboards, and the small metal frets that protrude from the fretboard also create clearance issues.

By using, two hinged member sections and having the face surface squared at the ends rather than radiused the hinged members can be placed much closer to the ends of the butt plates which will allow the hinge to give greater support when the hinge is opened by folding in the direction indicated by arrow 47 in the playing position illustrated in FIG. 1 and also properly realign the surfaces when closed.

Referring to FIG. 2, an exploded perspective of the inventive system incorporating the inventive hinge 48 as it may be installed in one possible application of the present invention, namely in a musical instrument neck, is illustrated. The shapes and sizes of neck 14, neck base 38, neck fretboard 34 and base fretboard 40 may take numerous configurations without affecting the function of the hinge 48, but are shown for purposes of illustration as to how the hinge might be installed in is application.

The hinge pockets 50 and 52 are shown as they might be cut by a vertical rotary machining process. This process is easier than the methods required for previous designs, such as that illustrated in my earlier U.S. Design Pat. No. 516,114. More particularly, the method of manufacturing the guitar neck illustrated in this patent required two pairs of cylindrical hinge pockets to be cut horizontally to receive the cylindrical loans of two separate Soss hinges.

In contrast, the accuracy needed to cut pockets 50 and 52 that are proportioned to the sizes of hinge butt plates 54*a* and 54*b* and correctly located to control depth aid height of the hinge installation is easily accomplished with the inventive design. This simplifies both small shop hand-cut methods as well as mass production. With the inventive method pockets 50 and 52 can be cut at any stage of manufacture prior to the attachment of neck fretboard 34 and base fretboard 40 to neck 14 and neck base 38. Such attachment may be achieved by gluing.

Once these parts are assembled they create a four-sided enclosure for the hinge butt plates to fully recess into the pockets. Two attachment screws 56 and 58 are deployed in holes 60 and 62 and screwed into holes 64 and 66, respectively. The result is that screws 56 and 58 secure the butt plates 54*a* and 54*b* to the parts. Because the screws are attached into the center of the neck 14 and neck base 38, there is greater mass for the screws to achieve a strong connection and eliminates the possibility of the screws splitting neck 14 or neck base 38. Additional attachment methods such as a barrel nut could also be used to allow for easy and repeatable installation and removal of the hinges as well as providing a very secure attachment method.

Referring to FIG. 1 the hinge butt plates 54*a* and 54*b* are connected by hinge links 68 and hinge pins 70 located at the top of the hinge butt plates. The links 68 are alternating left and right sets connected by hinge pin 70 at the rotation and pivot point. Hinge pins 72 are allowed to slide in recesses 74 and a manner typical of a Soss hinge. This action allows the hinge pivot pins 70 to move beyond the surface of the butt plate which allows for the necessary clearance for the guitar strings, frets and so forth.

A single center hole 76 is located in each butt plate. This location allows for a single fastening device such as a screw or bolt to be used for each butt plate.

Figure 4:
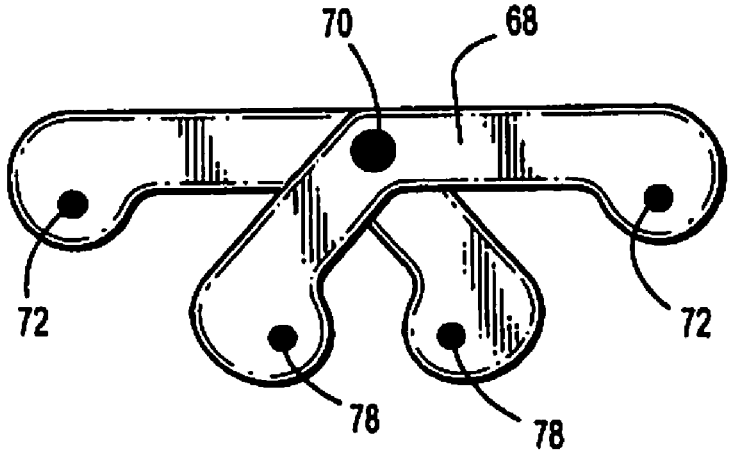
FIG. 4 is a plan view of the hinge links in a musical instrument as they would appear in the playing position.

FIG. 4 shows the approximate location of the hinge pins 70, sliding pins 72 and fixed rotation pins 78 in relation to the hinge links 68 as well as the general shape or the hinge links. The shape and location of hinge pins can be altered to create a hinge that opens further or acts differently as it is opened.

As can be seen most clearly in FIG. 1, neck 14 is secured in position by a screw 79. Screw 79 may be seen more clearly with reference to FIG. 5.

Figure 5:
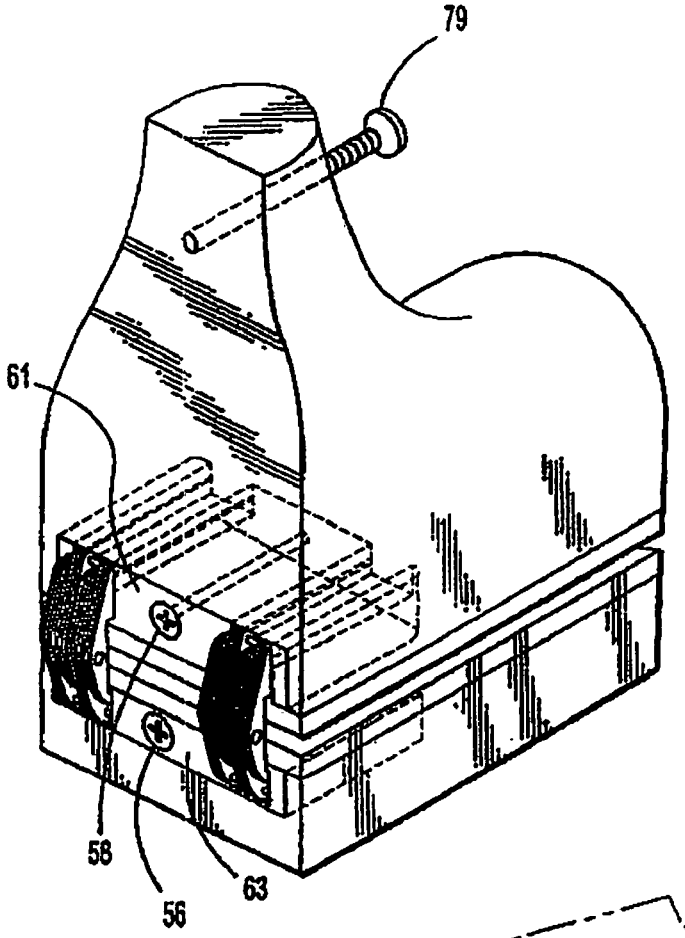
FIG. 5 is a perspective view of the hinge installed and in the open position.

FIG. 5 shows the hinge installed and in the folded position and shows how the butt plates 61 and 63 are concealed within the pockets 50 and 52 and how the attachment screws 56 and 58 are positioned in the final assembled structure. The neck 14, neck base 38, neck fretboard 34 and base fretboard 40 or illustrated in the assembled storage or travel position of the musical instrument neck. The inventive hinge may be suitable for other applications where a very narrow surface is available for the hinge mechanism and it must be able to support a proportionally much longer perpendicular surface.

Figure 3:
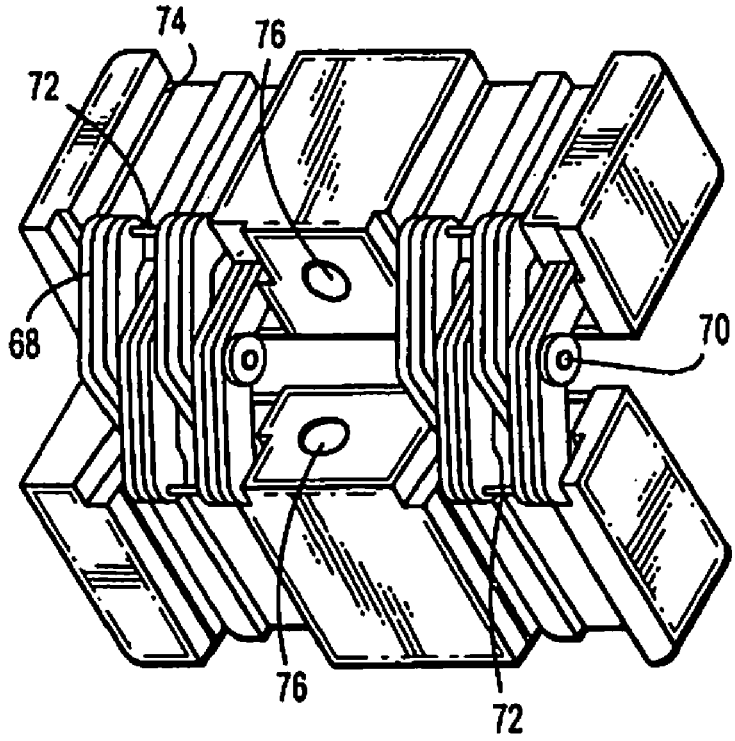
FIG. 3 is a perspective view of a hinge which may be employed in the inventive stringed musical instrument in a half-closed position, viewed from the bottom side, as the hinge would be deployed in a musical instrument such as a guitar or violin.

Referring to FIG. 1, when the neck 14 is positioned with respect to the guitar body 12, in the open or playing position, as a result of the movement of the hinge from the position illustrated in FIG. 5 through the position illustrated in FIG. 3 and on to the position illustrated in FIG. 2, the guitar made the conveniently played after the secure of screw 79 in hole 81.

Figure 6:
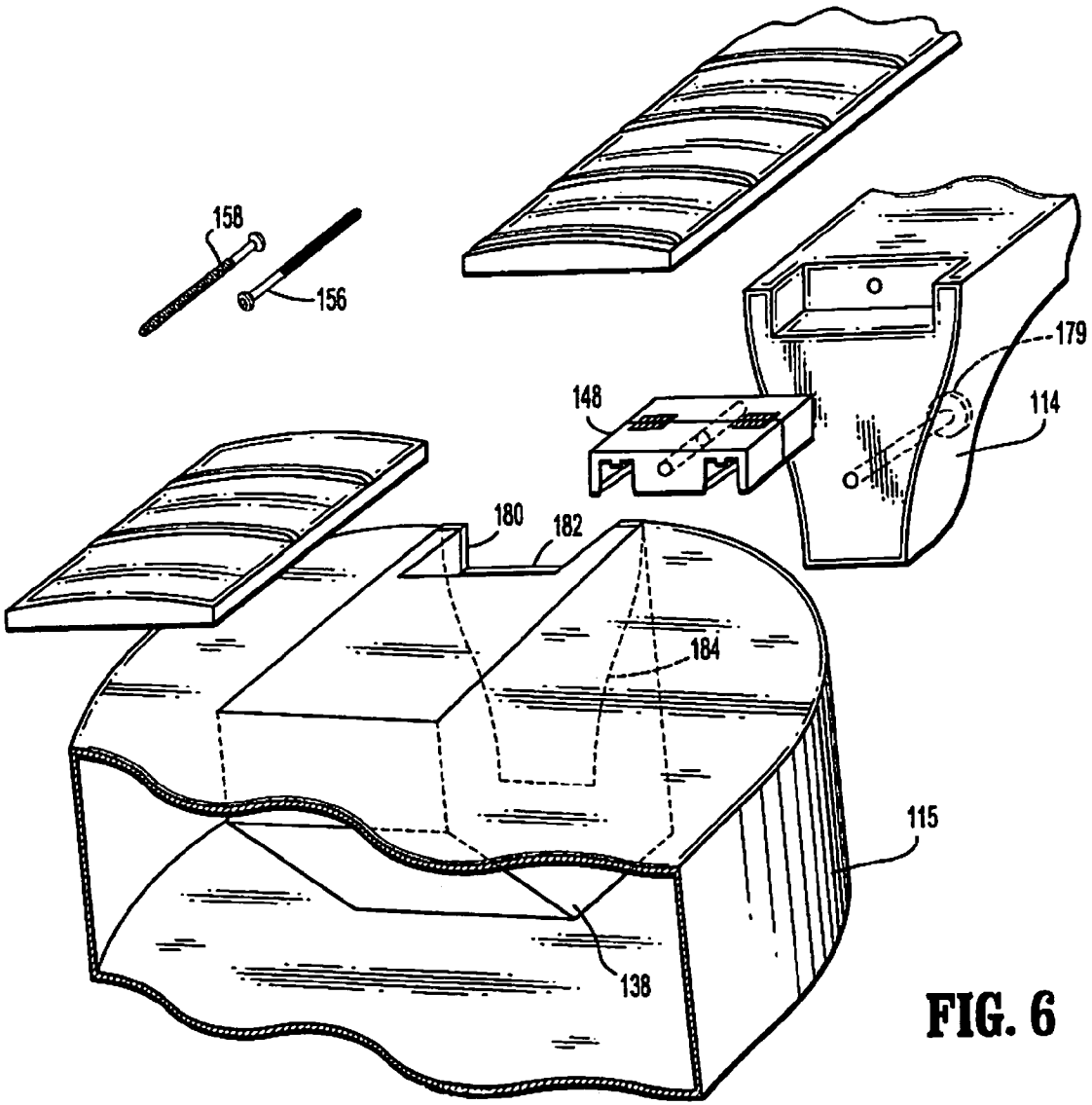
FIG. 6 is an exploded perspective view of an alternative configuration for the inventive traveling stringed musical instrument.

Referring to FIG. 6, alternative embodiments of the invention may be understood. In ibis embodiment, parts which perform similar or analogous functions are given reference numerals which all are 100 larger then corresponding parts in the embodiment of FIGS. 1-5. More particularly, in FIG. 6, a guitar 110 comprising a guitar body 112 has continuous sidewall bout which defines a notch 184 receiving hinge 148. A portion 182 of sidewall 115 is thus sandwiched between a heel block 138 and neck 114. Screw 179 secures neck 114 in the playing position by screwing into hole 181.

In the event that a particularly rigid securement of the neck is desired, a portion 184 of heel block 138 may alternatively extend through sidewall 115 which is cut out to match portion 184. The result is that the heel block is flush with the side wall.

Figure 7:
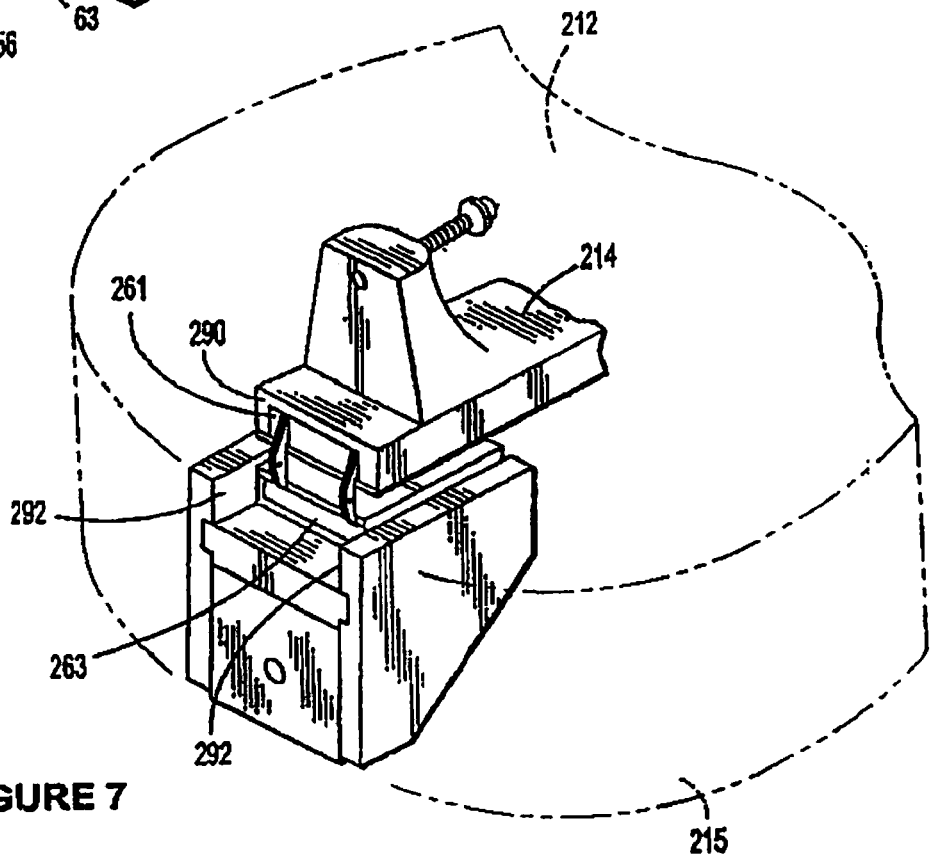
FIG. 7 illustrates the inventive instrument with the neck folded.

Still yet another alternative embodiment of the inventive guitar 210 comprising a guitar body 212 and a guitar neck 214 is illustrated in FIG. 7. In this embodiment, neck 214 folds at a breakpoint 290, which is inside from sidewalls 215 each as illustrated in FIG. 7, and as illustrated in phantom lines in FIG. 1. The result is added support for the neck 214 by sidewalls 292.

Figure 8:
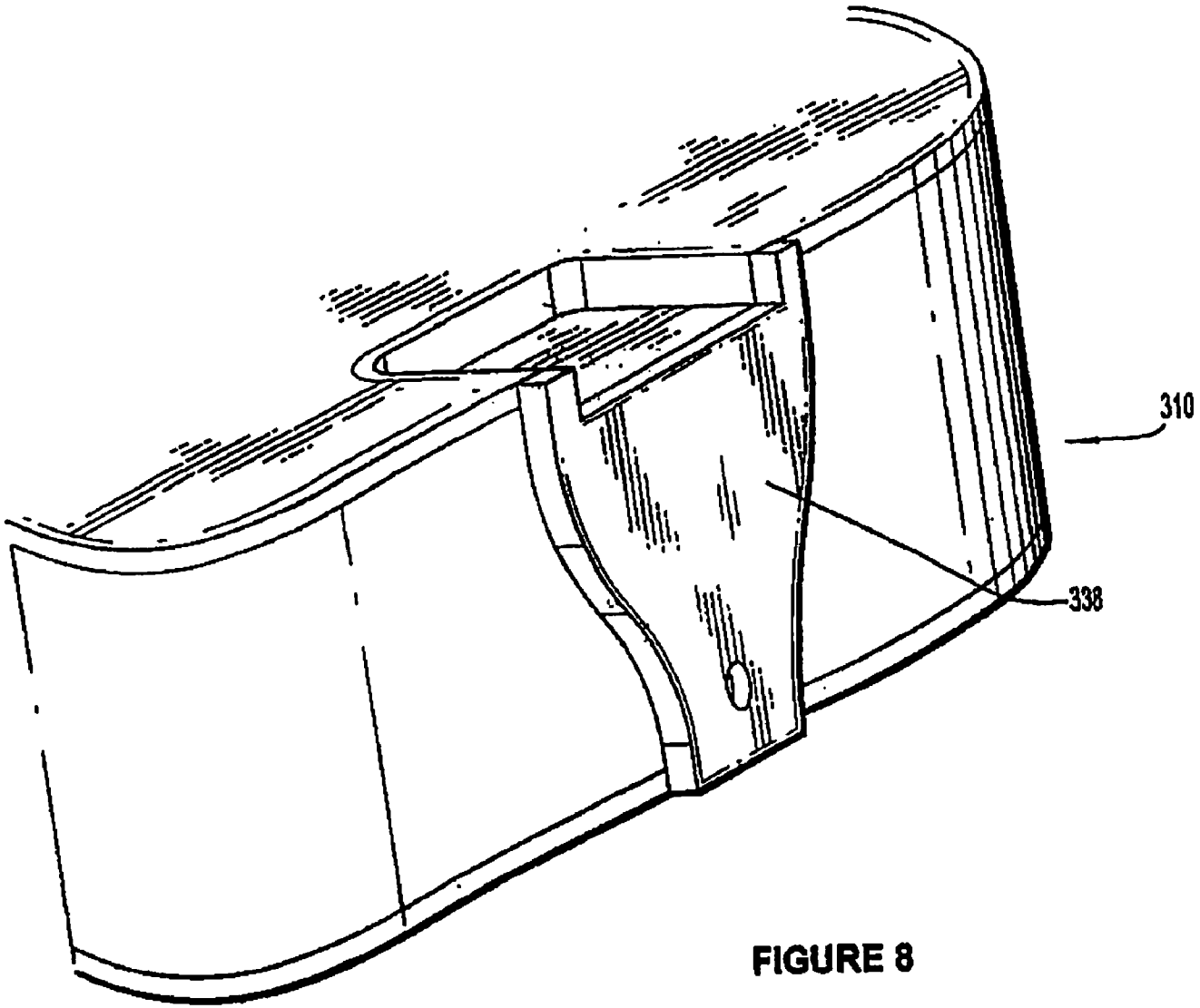
FIG. 8 illustrates an alternative embodiment with a protruding heel block.

Referring to FIG. 8, a guitar 310 incorporates a protruding heel block 338, as alluded to above.

In accordance with the invention, it is contemplated, that while the guitar neck is folded down, the guitar strings will be inserted through the hole and into the body of the guitar. It is also contemplated that the inventive structures may be applied to a solid body guitar, such as an electric guitar. In this case, the hole which in an acoustic guitar leads into the body of the acoustic guitar does not exist. Thus, there is limited space for the strings. In accordance with the present invention, it is contemplated that a groove or troth, or cylindrical or spherical volume may be cut into the solid guitar to allow place for the placement of strings. Alternatively, a hole with a diameter of, for example, five centimeters may be cut in the guitar. The guitar strings may be passed through this hole, allowing them to be laid flat against the backside of the guitar.

Figure 9:
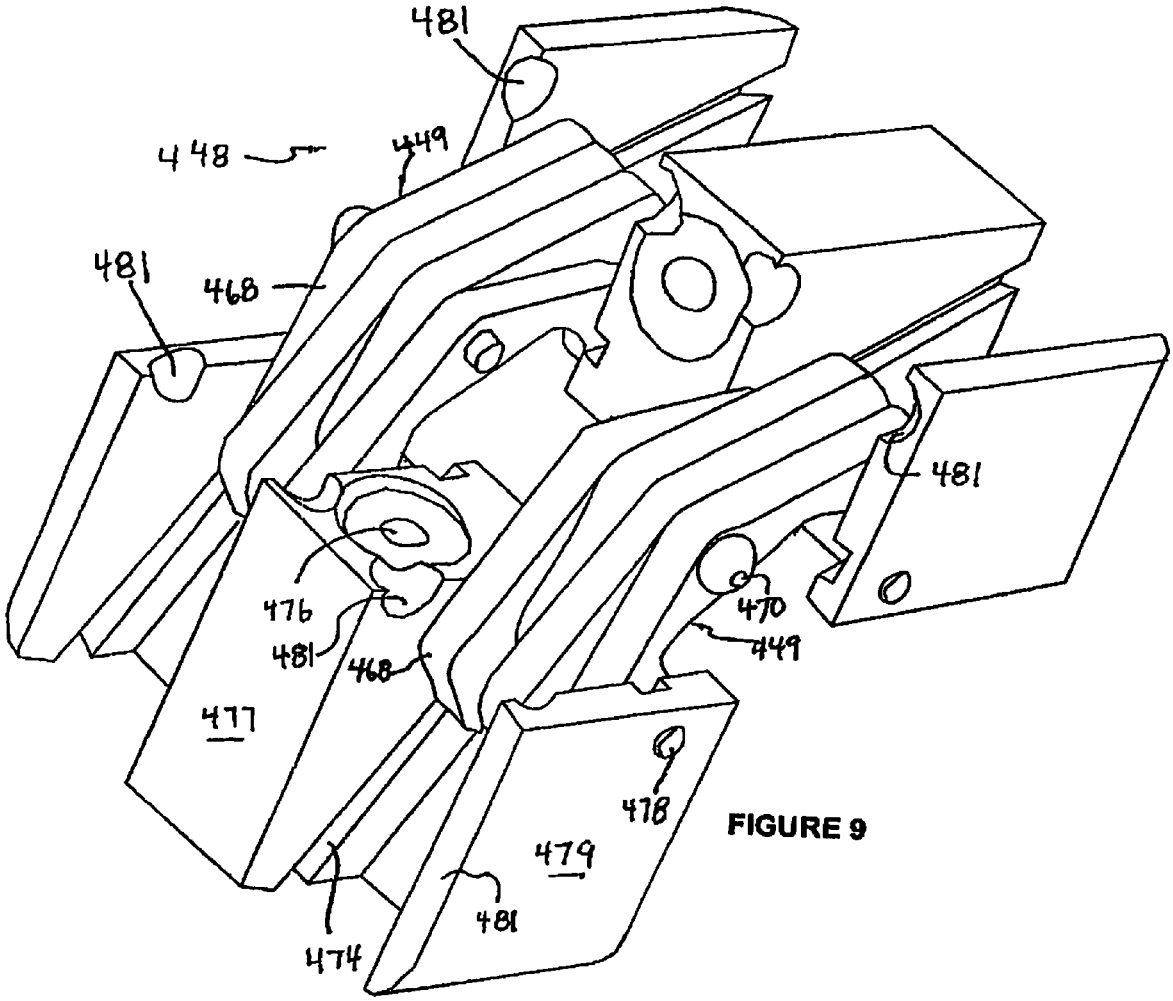
FIG. 9 is a perspective view of an alternative hinge in mid position.
Figure 10:
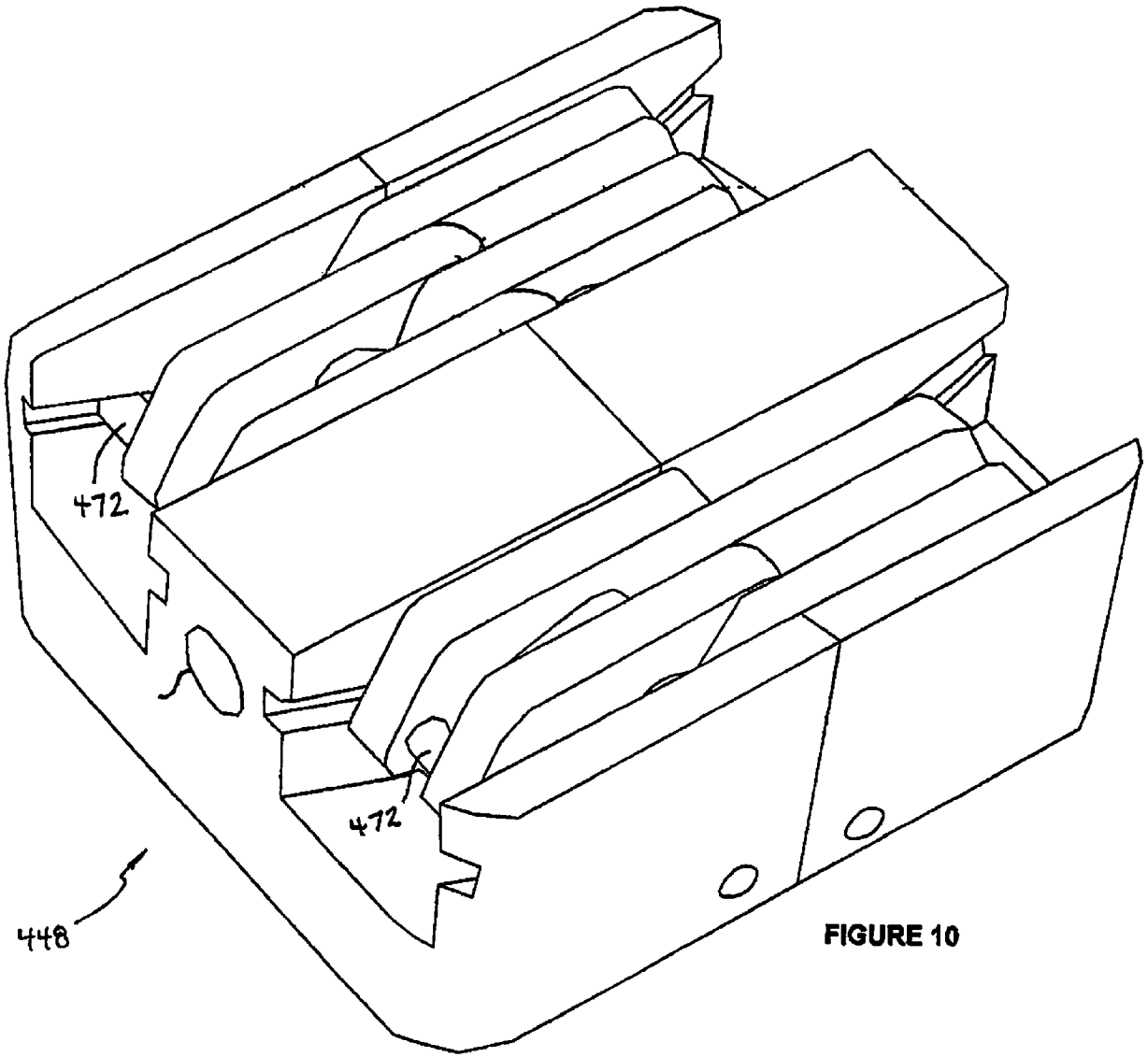
FIG. 10 is a respective view of the hinge of FIG. 9 in the closed position from the bottom.
Figure 11:
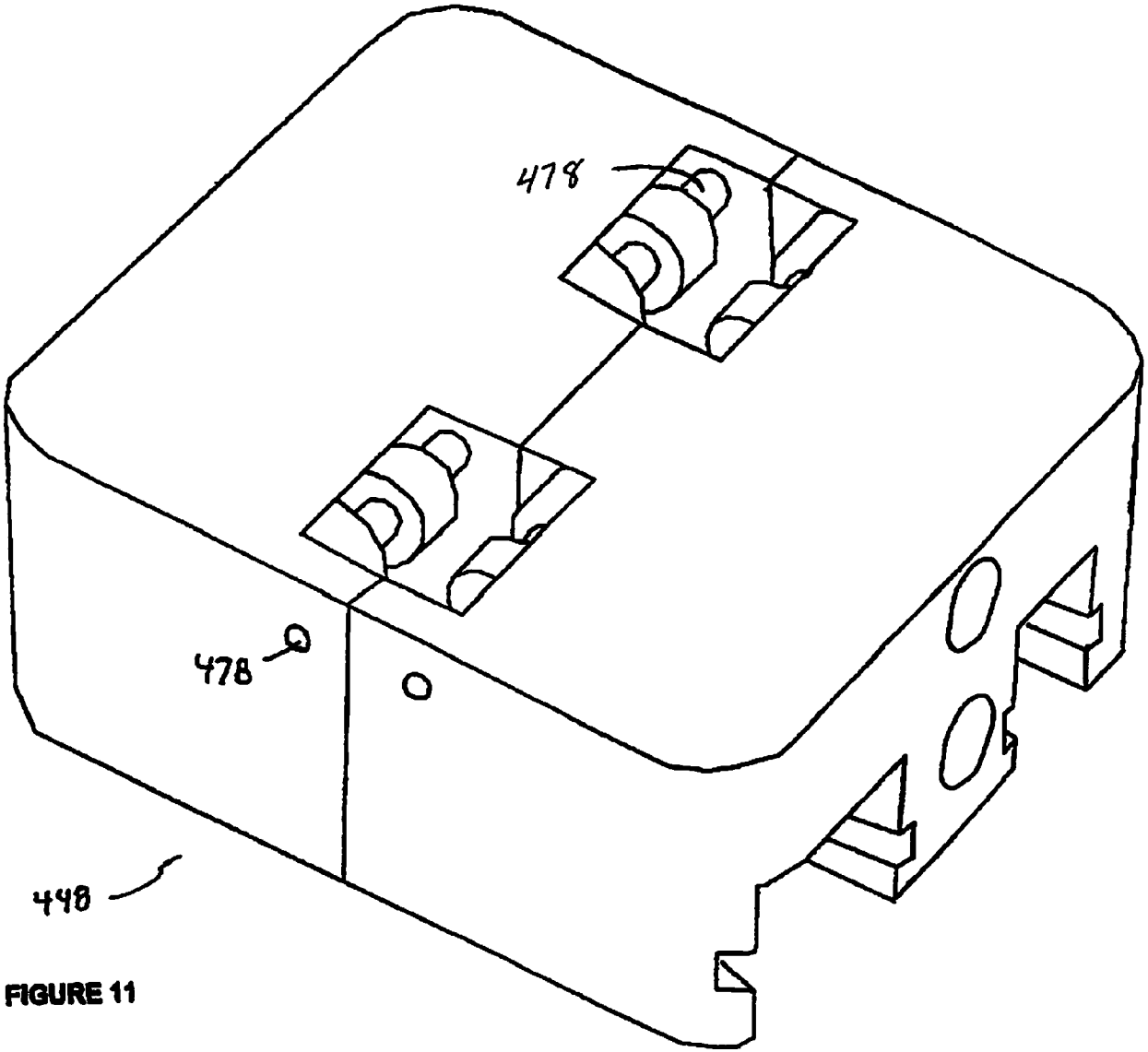
FIG. 11 is a perspective view of the hinge of FIG. 9 from the top.

A preferred embodiment of a hinge 448 is illustrated in FIGS. 9-11. Hinge 448 comprises Soss link assemblies 449, which comprise hinge links 468, hinge pins 470, hinge pins 472 and pins 478. The operation of this hinge is similar to the hinge illustrated in FIG. 3. However, advantages are provided by the placement of screw hole 476, which because it is proximate side 477 of hinge 448 supports a screw which is driven into the, for example, neck at a point where there is sufficient wood on all of the sides of the screw to provide excellent support. At the same time, sidewalls 479 have a relatively small thickness 481 which promotes making available added thickness for Soss link assemblies 449. Slanted backs 474 cooperate in providing the requisite configuration to allow use of the hinge in a guitar with a hinged neck.

In addition, compactness and strength is provided by thin receiving recesses 481, which allow the relatively large heads of robust pins 470 to be seated.

Figure 12:
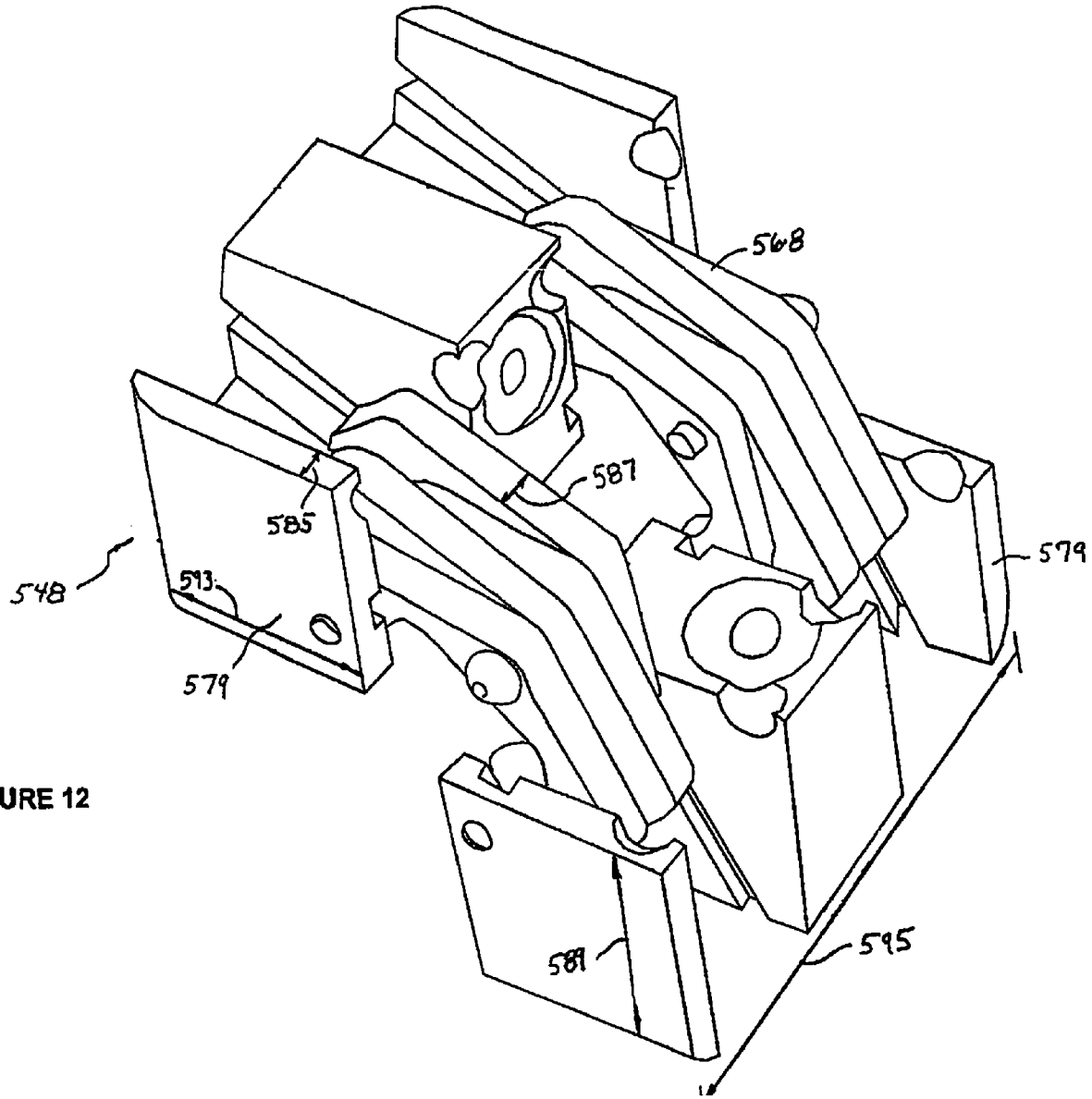
FIG. 12 is a view similar to FIG. 9 of another alternative hinge design.
Figure 13:
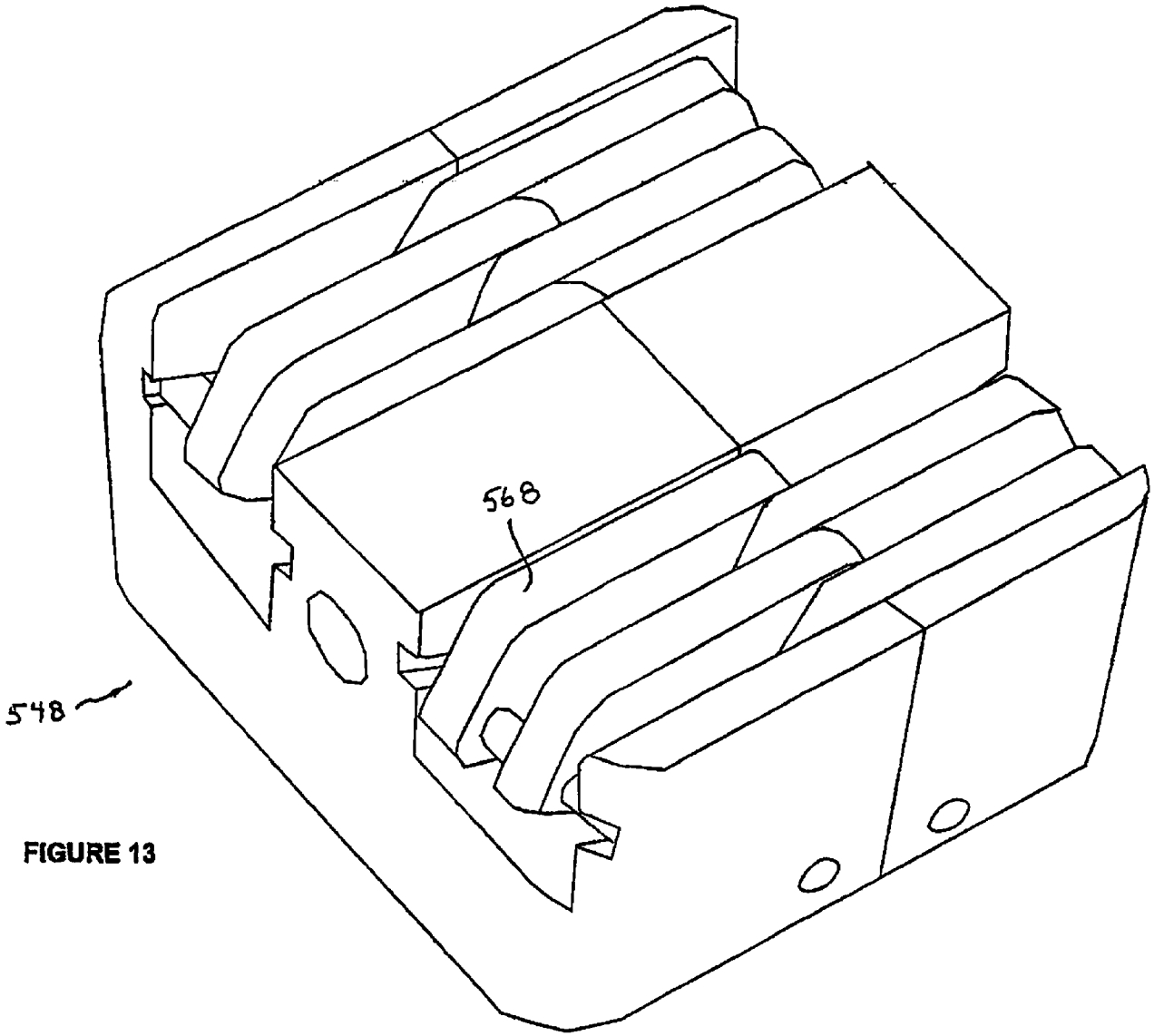
FIG. 13 is a view similar to FIG. 10 of the hinge illustrated in FIG. 12.
Figure 14:
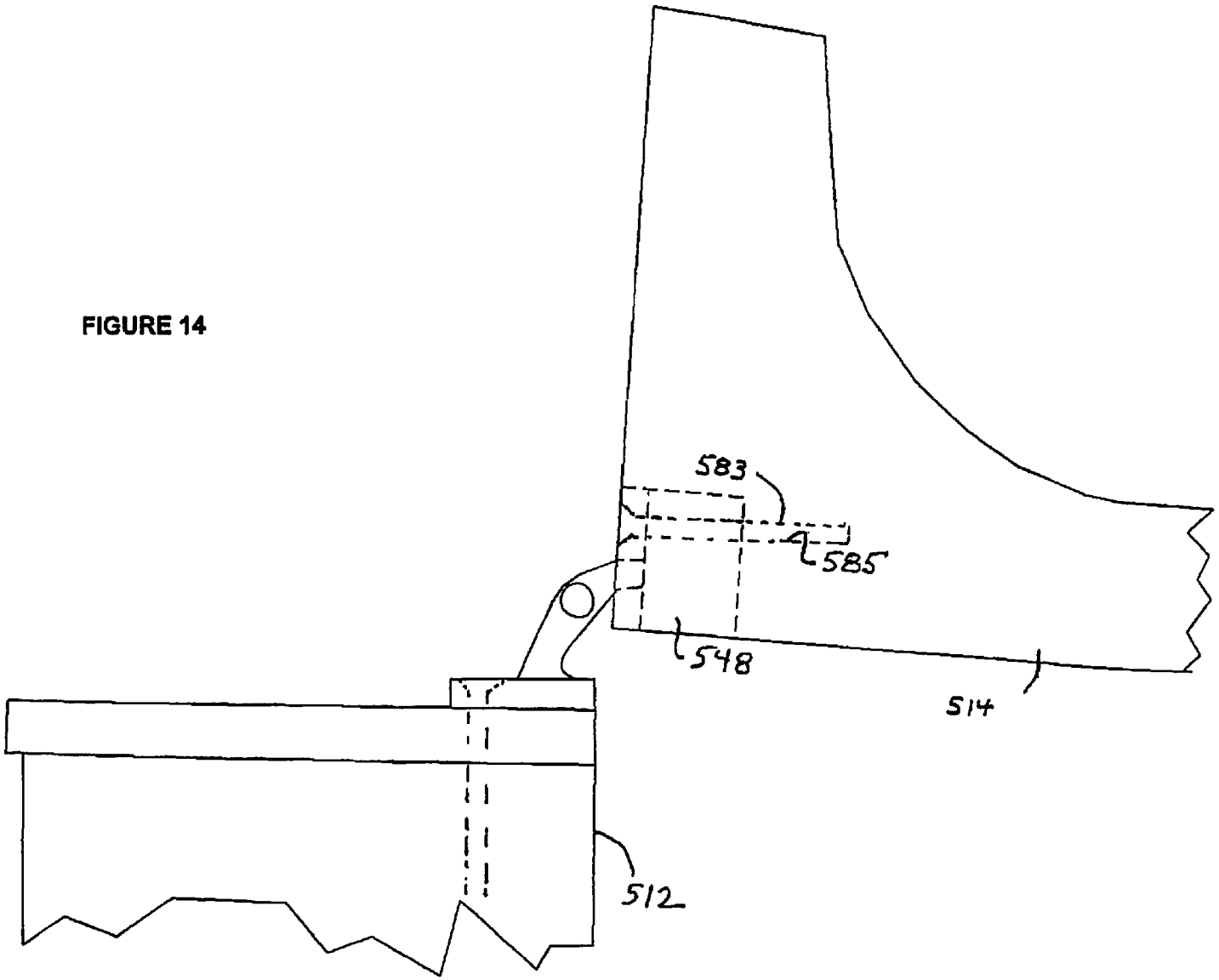
FIG. 14 illustrates the hinge of FIGS. 12 and 13 in use.

In accordance with a particularly preferred embodiment of the invention, it has been discovered that a short version of the hinge, as illustrated in FIGS. 12-13 is relatively advantageous. Hinge 548 is similar in construction otherwise to hinge 448. Part of the advantage of this construction may be seen from FIG. 14, where the shallower hinge butt results in a shorter lever arm acting through screw 583 to reduce the integrity of hole 585 in which screw 583 is seated, thus promoting the long-term stability of the guitar body 512 and guitar neck 514.

In accordance with a preferred embodiment, hinge 548 includes sidewalls 579 having a thickness 585 of approximately 0.25 cm. The thickness 587 of the links 568 is also 0.25 cm. The sidewalls 579 have a height 589 of 2 cm and a length 591 of 2 cm Sidewalls 579 have a length 593 of 2 cm. Likewise, in accordance with a preferred embodiment, hinge 548 has a width 595 of 4 cm.

While illustrative embodiments of the invention have been described, it is, of course, understood that various modifications will be obvious to those of ordinary skill in the art. Such modifications arc within the spirit and scope of the invention as illustrated and defined only by the appended claims.

The invention claimed is:

1. A hinge, comprising:

(a) a first substantially rigid hinge butt comprising a first butt base and defining:

(i) a first track comprising first and second races for receiving a first Soss sliding hinge pin;

(ii) a second track comprising third and fourth races for receiving a second Soss sliding hinge pin;

(b) a second substantially rigid hinge butt comprising a second butt base and defining:

(i) a third track comprising fifth and sixth races for receiving a third Soss sliding hinge pin;

(ii) a fourth track comprising seventh and eighth races for receiving a fourth Soss sliding hinge pin;

(c) a first Soss link assembly portion associated with said first Soss sliding hinge pin mounted in said first track;

(d) a second Soss link assembly portion associated with said second Soss sliding hinge pin mounted in said second track;

(e) a third Soss link assembly portion associated with said third Soss sliding hinge pin mounted in said third track, said first and third Soss link assembly portions being mounted on a first common pin and forming a first Soss link assembly; and (f) a fourth Soss link assembly portion associated with said fourth Soss sliding hinge pin mounted in said fourth track, said second and fourth Soss link assembly portions being mounted on a second common pin and forming a second Soss link assembly, wherein said first substantially rigid hinge butt further comprises first and second race support walls, said first and third races being defined in said first and second race supports walls, respectively, said first and second race support walls extending from said first butt base and wherein said second substantially rigid hinge butt further comprises third and fourth race support walls, said fifth and seventh races being defined in said third and fourth race support walls, respectively, said third and fourth race support walls extending from said second butt base, said Soss sliding hinge pins being mounted in respective tracks, said first and third Soss link assembly portions joined by a first assembly pin, and said second and fourth Soss link assembly portions joined by a second assembly pin.

2. A hinge as in claim 1, wherein:

(g) a first hole is defined in said first hinge butt, said first hole positioned between said first and second tracks; and (h) a second hole is defined in said second hinge butt, said second hole positioned between said first and second tracks.

3. A hinge as in claim 2, wherein said hinge butts are rectangular in configuration in three dimensions.

4. A hinge as in claim 3, wherein said hinge butts have sides that roughly define planes and rounded corners.

5. A hinge as in claim 3, wherein said hinge butts have flat sides and pointed substantially 90° corners.

6. A hinge as in claim 3, wherein said hole between said first and said second races is oriented roughly in the same direction as said races.

7. A hinge as in claim 2, wherein said hole between said first and said second races is oriented roughly in the same direction as said races.

8. A hinge as in claim 2, wherein said hinge is mounted proximate the base of the neck of a guitar having a neck with a fretboard and a guitar sound box and said tracks extend from points a first distance from the fretboard and near the center of said hinge when said hinge is in a closed position to points near the ends of said hinge and displaced at a second distance, said second distance being further from the fretboard of said stringed instrument as compared to said first distance and said hinge foldingly joins said neck to said sound box.

9. A hinge as in claim 2, wherein said Soss link assemblies comprise arms which pivot at pivot points adjacent one side of each butt of said hinge and said first hole and said second hole are positioned on the opposite side of said butt.

10. A hinge as in claim 2, wherein said hinge is positioned in a stringed instrument with one face of said hinge, when it is in the closed position, bearing against the fretboard of the instrument and said first hole and said second hole are positioned on the opposite side of said butt.

11. A hinge as in claim 2, wherein the outside sides of said butts in which said first, third, fifth and seventh races are defined have a thickness in that portion which defines said first, third, fifth and seventh races between five and ten percent the width of said hinge defined between the outside surfaces of the sidewalls of said hinge receiving said first and third races.

12. A hinge as in claim 2, wherein the outside sides of said butts in which said first, third, fifth and seventh races are defined have a thickness in that portion which defines said first, third, fifth and seventh races between seven and nine percent the width of said hinge defined between the outside surfaces of the sidewalls of said hinge receiving said first and third races.

13. A hinge as in claim 2, wherein the thickness of said Soss link assemblies in the direction of the axis of said hinge pins is between 30 and 70 percent the width of said hinge defined between the outside surfaces of the sidewalls of said hinge receiving said first and third races.

14. A hinge as in claim 2, wherein the outside sides of said butts in which said first, third, fifth and seventh races are defined have a length between 0.8 and 1.2 times their width.

15. A hinge as in claim 2, wherein said hinge is mounted proximate the base of the neck of a guitar and said tracks extend from points a first distance from the fretboard and near the center of said hinge when said hinge is in a closedposition to points near the ends of said hinge and displaced at a second distance, said second distance being further from the fretboard of said stringed instrument as compared to said first distance, and wherein said Soss link assemblies comprise arms which pivot at pivot points adjacent one side of each butt of said hinge and said first hole and said second hole are positioned on the opposite side of said butt.

16. A hinge as in claim 15, wherein said hinge is positioned in a stringed instrument with one face of said hinge, when it is in the closed position, bearing against the fretboard of the instrument and said first hole and said second hole are positioned on the opposite side of said butt.

17. A hinge as in claim 16, wherein the outside sides of said butts in which said first, third, fifth and seventh races are defined have a thickness in that portion which defines said first, third, fifth and seventh races between five and ten percent the width of said hinge defined between the outside surfaces of the sidewalls of said hinge receiving said first and third races.

18. A hinge as in claim 16, wherein the thickness of said Soss link assemblies in the direction of the axis of said hinge pins is between 30 and 70 percent the width of said hinge defined between the outside surfaces of the sidewalls of said hinge receiving said first and third races.

19. A hinge as in claim 1 , wherein the distance between said first and second Soss link assemblies is roughly large enough to accommodate a first center support member secured to said first hinge butt base and said third and fourth Soss link assemblies being roughly large enough to accommodate a second center support member secured to said second hinge butt base, said first and second center support members being roughly large enough to accommodate respective holes extending through respective ones of said center support members and its associated butt base.

20. A hinge, comprising:

(a) a first hidden hinge sliding hinge pin;

(b) a second hidden hinge sliding hinge pin;

(c) a third hidden hinge sliding hinge pin;

(d) a fourth hidden hinge sliding hinge pin;

(e) a first hinge butt, comprising a first substantially rigid member having a length, a width and a height, and defining:

(I) a first hinge mechanism receiving volume, said first hinge mechanism receiving volume extending from a point displaced from one end of the length of said rigid member a distance substantially less than half the length of said first substantially rigid member, and a first track disposed in said first hinge mechanism receiving volume comprising first and second races in facing spaced relationship for receiving said first hidden hinge sliding hinge pin;

(II) a second hinge mechanism receiving volume, said second hinge mechanism receiving volume extending from a point displaced from the other end of the length of said first substantially rigid member a distance substantially less than half the length of said rigid member, and a second track disposed in said second hinge mechanism receiving volume comprising third and fourth races in facing spaced relationship for receiving said second hidden hinge sliding hinge pin;

(h) a second hinge butt, comprising a second substantially rigid member having a length, a width and a height, and defining:

(I) a third hinge mechanism receiving volume, said third hinge mechanism receiving volume extending from a point displaced from one end of the length of said second substantially rigid member a distance substantially less than half the length of said second substantially rigid member, and a fifth track disposed in said third hinge mechanism receiving volume comprising fifth and sixth races in facing spaced relationship for receiving said third hidden hinge sliding hinge pin;

(II) a fourth hinge mechanism receiving volume, said fourth hinge mechanism receiving volume extending from a point displaced from other end of the length of said second substantially rigid member a distance substantially less than half the length of said second substantially rigid member, and a seventh track disposed in said fourth hinge mechanism receiving volume comprising seventh and eighth races in facing spaced relationship for receiving said fourth hidden hinge sliding hinge pin;

(i) a first hidden hinge link assembly mounted in said first track;

(j) a second hidden hinge link assembly mounted in said second track;

(k) a third hidden hinge link assembly mounted in said third track; and (l) a fourth hidden hinge link assembly mounted in said fourth track;

(m) a first mass of material being defined in said first hinge butt between said first and second hinge mechanism receiving volumes, said first mass of material defining a first hole for securing said first hinge butt; and (n) a second mass of material being defined in said second hinge butt between said third and fourth hinge mechanism receiving volumes, said second mass of material defining a second hole for securing said second hinge butt.

21. A hinge as in claim 19, wherein said first hole extends in the direction of the width of said first hinge butt, and said second whole extends in the direction of the width of said second hinge butt.

* * * * *